US008988323B2

(12) United States Patent
Ryu

(10) Patent No.: US 8,988,323 B2
(45) Date of Patent: Mar. 24, 2015

(54) ORGANIC LIGHT EMITTING DISPLAY AND CONTROL SIGNAL GENERATING CIRCUIT OF ORGANIC LIGHT EMITTING DISPLAY

(75) Inventor: Do-Hyung Ryu, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 745 days.

(21) Appl. No.: 13/082,673

(22) Filed: Apr. 8, 2011

(65) Prior Publication Data

US 2011/0279492 A1 Nov. 17, 2011

(30) Foreign Application Priority Data

May 17, 2010 (KR) ..... 10-2010-0046094

(51) Int. Cl.
*G09G 3/30* (2006.01)
*G09G 3/32* (2006.01)

(52) U.S. Cl.
CPC ..... *G09G 3/3266* (2013.01)
USPC ..... 345/76; 313/483; 315/169.3

(58) Field of Classification Search
CPC ..... G09G 3/3266; G09G 3/3677; G09G 2310/0267
USPC ..... 313/483–512; 315/169.1, 169.3; 345/76–83
See application file for complete search history.

(56) References Cited

U.S. PATENT DOCUMENTS

| | | | | |
|---|---|---|---|---|
| 3,871,363 | A * | 3/1975 | Day | 600/510 |
| 4,458,646 | A * | 7/1984 | Suzuki et al. | 123/406.36 |
| 4,904,958 | A * | 2/1990 | Wyatt | 331/17 |
| 5,633,855 | A * | 5/1997 | Naito | 369/59.19 |
| 6,556,685 | B1 * | 4/2003 | Urry et al. | 381/94.1 |
| 2004/0120699 | A1 * | 6/2004 | Lin | 388/804 |
| 2006/0022912 | A1 * | 2/2006 | Park et al. | 345/76 |

FOREIGN PATENT DOCUMENTS

| | | |
|---|---|---|
| KR | 10-2005-0110198 | 11/2005 |
| KR | 1020050113705 | 12/2005 |
| KR | 10-2006-0041097 | 5/2006 |
| KR | 10-0732083 B1 | 6/2007 |
| KR | 100742634 B | 7/2007 |
| KR | 10-2008-0013730 | 2/2008 |

OTHER PUBLICATIONS

Machine translation of KR 10-2006-0094027.*

* cited by examiner

*Primary Examiner* — Michael Pervan
(74) *Attorney, Agent, or Firm* — Robert E. Bushnell, Esq.

(57) ABSTRACT

A signal generating circuit generating an output signal corresponding to a controlling input, the signal generating circuit including a rising path increasing the output signal during a rising period in synchronization with a time that the controlling input is increased, and a falling path decreasing the output signal during a falling period in synchronization with a time that the controlling input is decreased, wherein the rising period and the falling period are different from each other.

16 Claims, 7 Drawing Sheets

ORGANIC LIGHT EMITTING DISPLAY AND CONTROL SIGNAL GENERATING CIRCUIT OF ORGANIC LIGHT EMITTING DISPLAY

CLAIM OF PRIORITY

This application makes reference to, incorporates the same herein, and claims all benefits accruing under 35 U.S.C. §119 from an application filed in the Korean Intellectual Property Office on May 17, 2010 and there duly assigned Serial No. 10-2010-0046094.

BACKGROUND OF THE INVENTION

1. Field of the Invention

The present invention relates to a control signal generating circuit generating a control signal used for an organic light emitting diode (OLED) display for signals such as a scan signal, a data signal or a light emitting signal.

2. Description of the Related Art

Various kinds of flat display devices that are capable of reducing detriments of cathode ray tubes (CRT), such as their heavy weight and large size, have been developed in recent years. Such flat display devices include liquid crystal displays (LCDs), field emission displays (FEDs), plasma display panels (PDPs), and organic light emitting diode OLED displays.

Among the above flat panel displays, the OLED display using an organic light emitting diode OLED generating light by a recombination of electrons and holes for the display of images has a fast response speed, is driven with low power consumption, and has excellent luminous efficiency, luminance, and viewing angle such that it has been spotlighted.

Generally, the organic light emitting diode OLED display is classified into a passive matrix OLED (PMOLED) and an active matrix OLED (AMOLED) according to a driving method of the organic light emitting diode OLED.

Of them, the active matrix in which unit pixels are selectively lit is primarily used in terms of resolution, contrast, and operation speed.

A predetermined time is required when increasing and decreasing a control signal controlling a display device such as the AMOLED. Conventionally, the rising period (Tr) and the falling period (Tf) of the various input signals of the AMOLED (for example, a scan signal, a data signal, a light emitting signal) are controlled by a time constant such that they are generally designed to be increased and decreased while drawing the same curved line.

However, when there is a short circuit in the rising period or the falling period in the driving method of the circuit of the AMOLED, a very large current flows into the AMOLED such that the element characteristic and reliability may be deteriorated.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention is capable of asymmetrically controlling the rising period (Tr) and the falling period (Tf) light emitting signals according to a driving method of each pixel of an organic light emitting diode (OLED) display.

The technical objects of the present invention are not limited by the above technical object, and other technical objects that are not mentioned will be apparently understood by a person of ordinary skill in the art from the following description.

A signal generating circuit generating an output signal corresponding to a controlling input according to an exemplary embodiment of the present invention includes a rising path increasing the output signal during a rising period in synchronization with a time that the controlling input is increased, and a falling path decreasing the output signal during a falling period in synchronization with a time that the controlling input is decreased, wherein the rising period and the falling period are different from each other.

The rising path may include a first resistor, a first diode, and a capacitor, the first diode may be turned on in synchronization with the time that the controlling input is increased, and the power source voltage may be charged to the capacitor through the first resistor according to the controlling input.

The falling path may include a second resistor, a second diode, and a capacitor, the second diode may be turned on in synchronization with the time that the controlling input is decreased, and the voltage charged to the capacitor may be discharged through the second resistor according to the controlling input.

A controlling switch including one terminal connected to the first resistor and the second resistor and a gate electrode input with the controlling input, and a DC power unit connected to the other terminal of the controlling switch, may be further included. The controlling switch may be a switching transistor.

The first resistor may include one terminal connected to one terminal of the controlling switch and the other terminal connected to an anode of the first diode, the second resistor may include one terminal connected to one terminal of the controlling switch and the other terminal connected to a cathode of the second diode, the first diode may include an anode connected to the other terminal of the first resistor and a cathode connected to one terminal of the capacitor, and the second diode may include a cathode connected to the other terminal of the second resistor and an anode connected to one terminal of the capacitor.

The signal generating circuit may further include a controlling operational amplifier including an output terminal connected to one terminal of the capacitor, an inverting input terminal connected to the anode of the second diode and the cathode of the first diode, and a non-inverting input terminal connected to ground.

The controlling input may be transmitted to one terminal of the first resistor and one terminal of the second resistor.

The first resistor may include one terminal connected to one terminal of the second resistor and the other terminal connected to the anode of the first diode, the second resistor may include one terminal connected to the other terminal of the first resistor and the other terminal connected to the cathode of the second diode, the first diode may include an anode connected to the other terminal of the first resistor and a cathode connected to the non-inverting input terminal of the controlling operational amplifier, and the second diode may include a cathode connected to the other terminal of the second resistor and a anode connected to the non-inverting input terminal of the controlling operational amplifier.

A display device according to another exemplary embodiment of the present invention includes: a display unit including a plurality of pixels, a plurality of scan lines, a plurality of data lines, and a plurality of light emission control lines; a data driver transmitting a plurality of data signals to the plurality of data lines; a scan driver transmitting a plurality of scan signals to the plurality of scan lines; a light emission control driver transmitting a plurality of light emitting signals to the plurality of light emission control lines; and a timing controller generating a light emission control signal to control the light emission control driver, wherein the light emission control driver includes a rising path increasing the output signal during a rising period in synchronization with a time that the light emission control signal is increased; and a falling path decreasing the output signal during a falling period in synchronization with a time that the light emission control signal is decreased, wherein a plurality of signal generating circuits of the rising period and the falling period are different from each other, and the plurality of controlling circuits transmit the light emitting signal into the corresponding light emission control line among the plurality of light emission control lines.

The rising path may include a first resistor, a first diode, and a capacitor, the first diode may be turned on in synchronization with the time that the light emission control signal is increased, and the power source voltage may be charged to the capacitor through the first resistor according to the light emission control signal.

The falling path may include a second resistor, a second diode, and a capacitor, the second diode may be turned on in synchronization with the light emission control signal being decreased, and the voltage charged to the capacitor may be discharged through the second resistor according to the light emission control signal.

The display device may further include a controlling switch including one terminal connected to the first resistor and the second resistor and a gate electrode input with the light emission control signal, and a DC power unit connected to the other terminal of the controlling switch. The controlling switch may be a switching transistor.

The first resistor may include one terminal connected to one terminal of the controlling switch and the other terminal connected to an anode of the first diode, the second resistor may include one terminal connected to one terminal of the controlling switch and the other terminal connected to a cathode of the second diode, the first diode may include an anode connected to the other terminal of the first resistor and a cathode connected to one terminal of the capacitor, and the second diode may includes a cathode connected to the other terminal of the second resistor and an anode connected to one terminal of the capacitor.

The display device may further include a controlling operational amplifier including an output terminal connected to one terminal of the capacitor, an inverting input terminal connected to the anode of the second diode and the cathode of the first diode, and a non-inverting input terminal connected to ground.

The light emission control signal may be transmitted to one terminal of the first resistor and one terminal of the second resistor.

The first resistor may include one terminal connected to one terminal of the second resistor and the other terminal connected to the anode of the first diode, the second resistor may include one terminal connected to the other terminal of the first resistor and the other terminal connected to the cathode of the second diode, the first diode may include an anode connected to the other terminal of the first resistor and a cathode connected to the non-inverting input terminal of the controlling operational amplifier, and the second diode may include a cathode connected to the other terminal of the second resistor and a anode connected to the non-inverting input terminal of the controlling operational amplifier.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
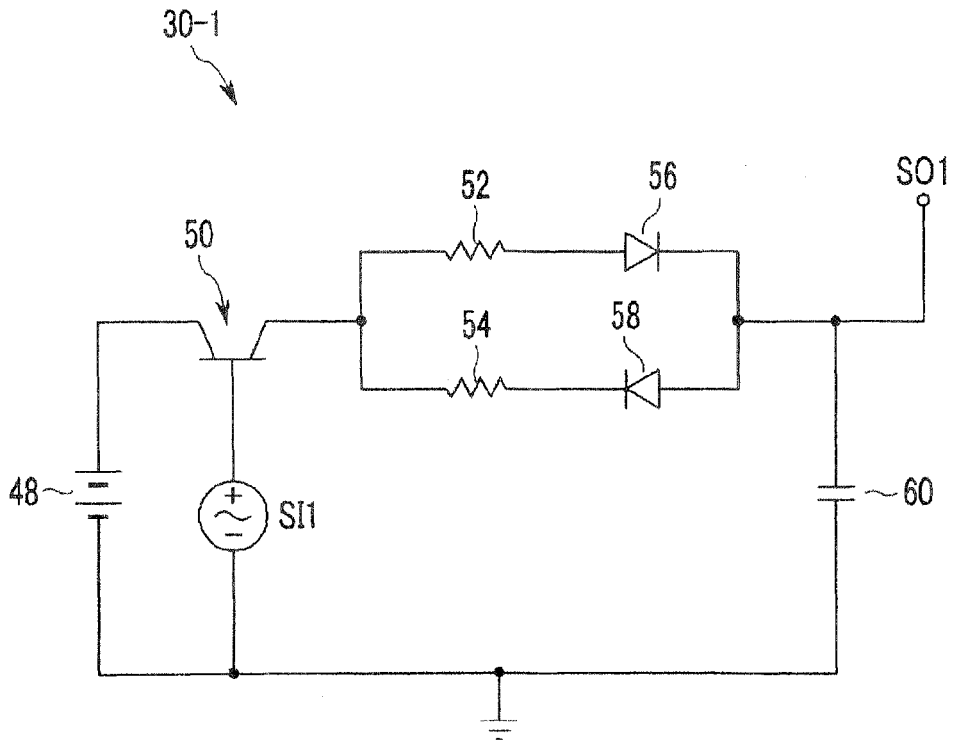
FIG. 1 is a circuit diagram of a signal generating circuit according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

Figure 2:
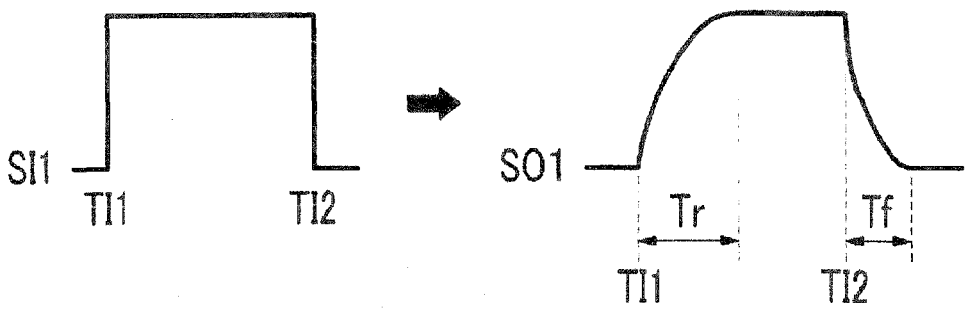
FIG. 2 is an input and an output waveforms of a signal generating circuit according to the exemplary embodiment shown in FIG. 1.

FIG. 1 is a circuit diagram of a signal generating circuit according to a first exemplary embodiment of the present invention, and FIG. 2 is an input and an output waveforms of the signal generating circuit according to the first exemplary embodiment shown in FIG. 1.

Referring to FIG. 1, a signal generating circuit 30-1 includes a DC power unit 48, a controlling switch (transistor) 50, a first resistor 52, a second resistor 54, a first diode 56, a second diode 58, and a first capacitor 60.

In detail, the controlling switch 50 is connected to a first controlling input SI1, and includes a gate electrode supplied with the first controlling input SI1, one terminal connected to the DC power unit 48, and the other terminal connected to the first resistor 52 and the second resistor 54.

The first resistor 52 and the first diode 56 are coupled in series, and the first resistor 52 includes one terminal connected to the second resistor 54 and the controlling switch 50 and the other terminal connected to the anode of the first diode 56. The first diode 56 includes the anode connected to the other terminal of the first resistor 52 and the cathode connected to one terminal of the first capacitor 60.

The second resistor 54 and the second diode 58 are coupled in series, and the second resistor 54 includes one terminal connected to the first resistor 52 and the controlling switch 50 and the other terminal connected to the cathode of the second diode 58. The second diode 58 includes the cathode connected to the other terminal of the second resistor and the anode connected to one terminal of the first capacitor 60.

The first capacitor 60 includes one terminal connected to the cathode of the first diode 56 and the anode of the second diode 58 and the other terminal connected to the other terminal of the first controlling input SI1.

If the signal of a high level is input to the first controlling input SI1 at the time TI1 as shown in FIG. 2, the controlling switch 50 is turned on. The anode voltage of the first diode 56 and the cathode voltage of the second diode 58 are increased by the DC power unit 48, the first diode 56 is turned on, and the second diode 58 is blocked. Thus, the first capacitor 60 is charged by the voltage of the DC power unit 48, and the charging path of the first capacitor 60 includes the first resistor 52 and the first diode 56. The first controlling output SO1 is increased by the charging of the first capacitor 60.

The first controlling input SI1 is a square wave such that the first controlling output SO1 starts to be increased in synchronization with the rising time of the first controlling input SI1 and becomes the high level, and the high level is maintained during a predetermined period. Accordingly, the first controlling output SO1 has the waveform that is increased during the predetermined rising period among the period that the first controlling input SI1 is maintained at the high level. Here, the rising period is determined by the first resistor 52 and the first capacitor 60. Here, the time constant is the product of R1 (the resistance of the first resistor) and C1 (the capacitance of the first capacitor).

If the first controlling input SI1 becomes the low level at the time TI2, the controlling switch 50 is turned off. The anode voltage of the first diode 56 is lower than the cathode voltage such that the first diode 56 is blocked, and the anode voltage of the second diode 58 is higher than the cathode voltage such that the second diode 58 is turned on. Thus, the first capacitor 60 is discharged through the second resistor 54 and the second diode 58. Accordingly, the first controlling output SO1 is reduced.

The first controlling input SI1 is the square wave such that the first controlling output SO1 starts to be decreased in synchronization with the falling time of the first controlling input SI1, becomes the low level, and is maintained at the low level during the predetermined period. Accordingly, the first controlling output SO1 has the waveform that is decreased during the predetermined falling period among the period that the first controlling input SI1 is maintained at the low level. Here, the falling period is determined by the second resistor 54 and the first capacitor 60. Here, the time constant is the product of R2 (the resistance of the second resistor) and C1 (the capacitance of the first capacitor).

Figure 3:
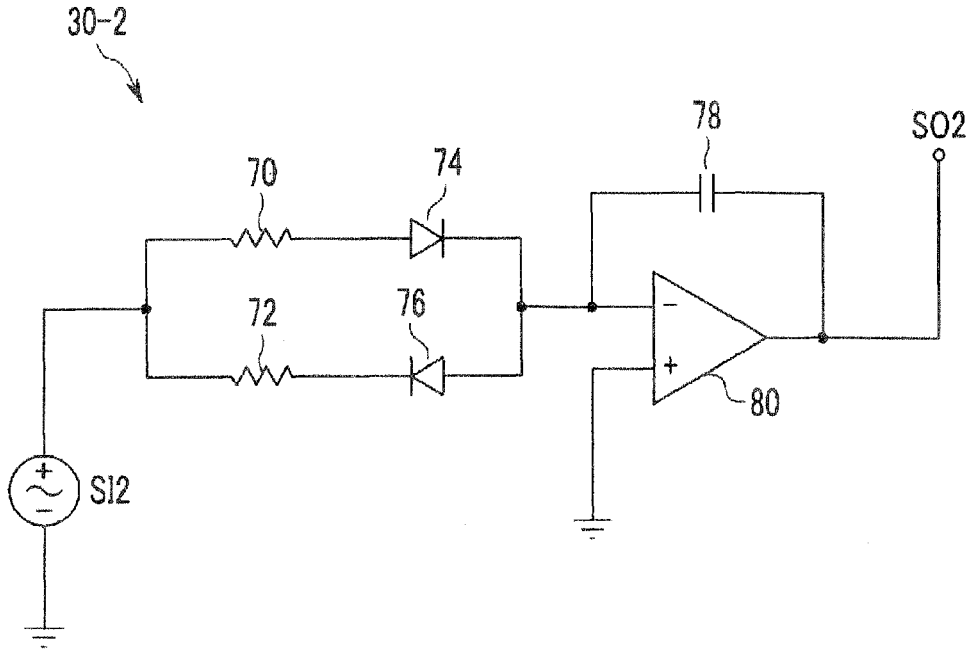
FIG. 3 is a circuit diagram of a signal generating circuit according to a second exemplary embodiment of the present invention.
Figure 4:
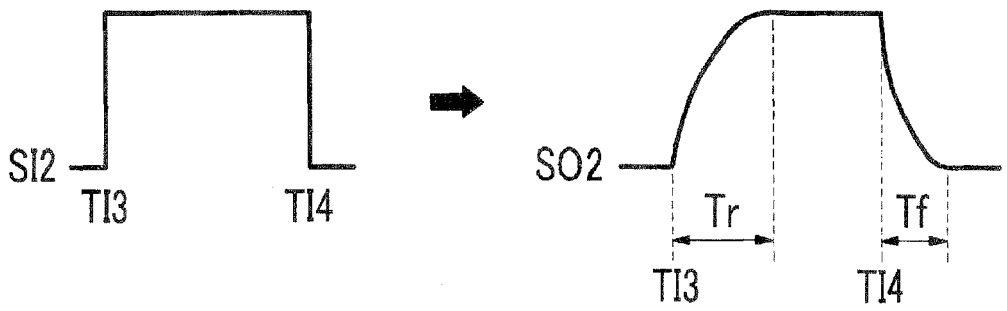
FIG. 4 is an input and an output waveforms of a signal generating circuit according to the second exemplary embodiment shown in FIG. 3.

FIG. 3 is a circuit diagram of a signal generating circuit according to a second exemplary embodiment of the present invention, and FIG. 4 shows input and output waveforms of a circuit according to the second exemplary embodiment shown in FIG. 3.

Referring to FIG. 3, a signal generating circuit 30-2 includes a third resistor 70, a fourth resistor 72, a third diode 74, a fourth diode 76, a second capacitor 78, and a controlling operational amplifier 80.

In detail, the third resistor 70 and the third diode 74 are coupled in series, the third resistor 70 includes one terminal connected to one terminal of the fourth resistor 72 and the second controlling input signal SI2, and the other terminal connected to the anode of the third diode 74. The third diode 74 includes the anode connected to the other terminal of the third resistor, and the cathode connected to one terminal of the second capacitor 78 and an inverting input terminal of the controlling operational amplifier 80.

The fourth resistor 72 and the fourth diode 76 are coupled in series, and the fourth resistor 72 includes one terminal connected to one terminal of the third resistor 70 and the second controlling input signal SI2, and the other terminal connected to the cathode of the fourth diode 76. The fourth diode 76 includes the cathode connected to the other terminal of the fourth resistor, and the anode connected to one terminal of the second capacitor 78 and the inverting input terminal of the controlling operational amplifier 80.

The second capacitor 78 includes one terminal connected to the inverting input terminal of the controlling operational amplifier 80 and the other terminal connected to the output terminal of the controlling operational amplifier 80. The controlling operational amplifier 80 includes the non-inverting input terminal connected to ground, the inverting input terminal connected to one terminal of the second capacitor 78, the third diode 74, and the fourth diode 76, and the output terminal connected to the other terminal of the second capacitor 78.

If the second controlling input SI2 is increased to the high level at the time TI3 as shown in FIG. 4, the third diode 74 is turned on and the fourth diode 76 is blocked such that the second controlling input SI1 becomes the second controlling output SO2 through an integrator including the third resistor 70, the second capacitor 78, and the controlling operational amplifier 80. The second controlling input SI2 is a square wave such that the second controlling output SO2 starts to be increased in synchronization with the rising time of the second controlling input SI2 and becomes the high level, and the high level is maintained during a predetermined period. Accordingly, the second controlling output SO2 has the waveform that is increased during the predetermined rising period among the period that the second controlling input SI2 is maintained at the high level. Here, the rising period is determined by the third resistor 70 and the second capacitor 78. Here, the time constant is the product of R3 (the resistance of the third resistor) and C2 (the capacitance of the second capacitor).

If the second controlling input SI2 is decreased to the low level at the time TI4, the third diode 74 is blocked and the fourth diode 76 is turned on such that the second controlling input SI2 becomes the second controlling output SO2 through the integrator including the fourth resistor 72, the second capacitor 78, and the controlling operational amplifier 80. The second controlling input SI2 is the square wave such that the second controlling output SO2 starts to be decreased in synchronization with the falling time of the second controlling input SI2, becomes the low level, and is maintained at the low level during the predetermined period. Accordingly, the second controlling output SO2 has the waveform that is decreased during the predetermined falling period among the period that the second controlling input SI2 is maintained at the low level. Here, the falling period is determined by the fourth resistor 72 and the second capacitor 78. Here, the time constant is the product of R4 (the resistance of the fourth resistor) and C2 (the capacitance of the second capacitor).

At least one of the first and second controlling output signals is the output signal of at least one of the drivers of the organic light emitting diode (OLED) display of the present invention, and particularly in the case of a simultaneous emission with active voltage type that will be described hereafter, when there is a short circuit in the rising period (Tr) or the falling period (Tf), the very large current flows such that the characteristic and the reliability of the elements may be deteriorated. The description thereof will be described after the description of the organic light emitting diode (OLED) display.

Figure 5:
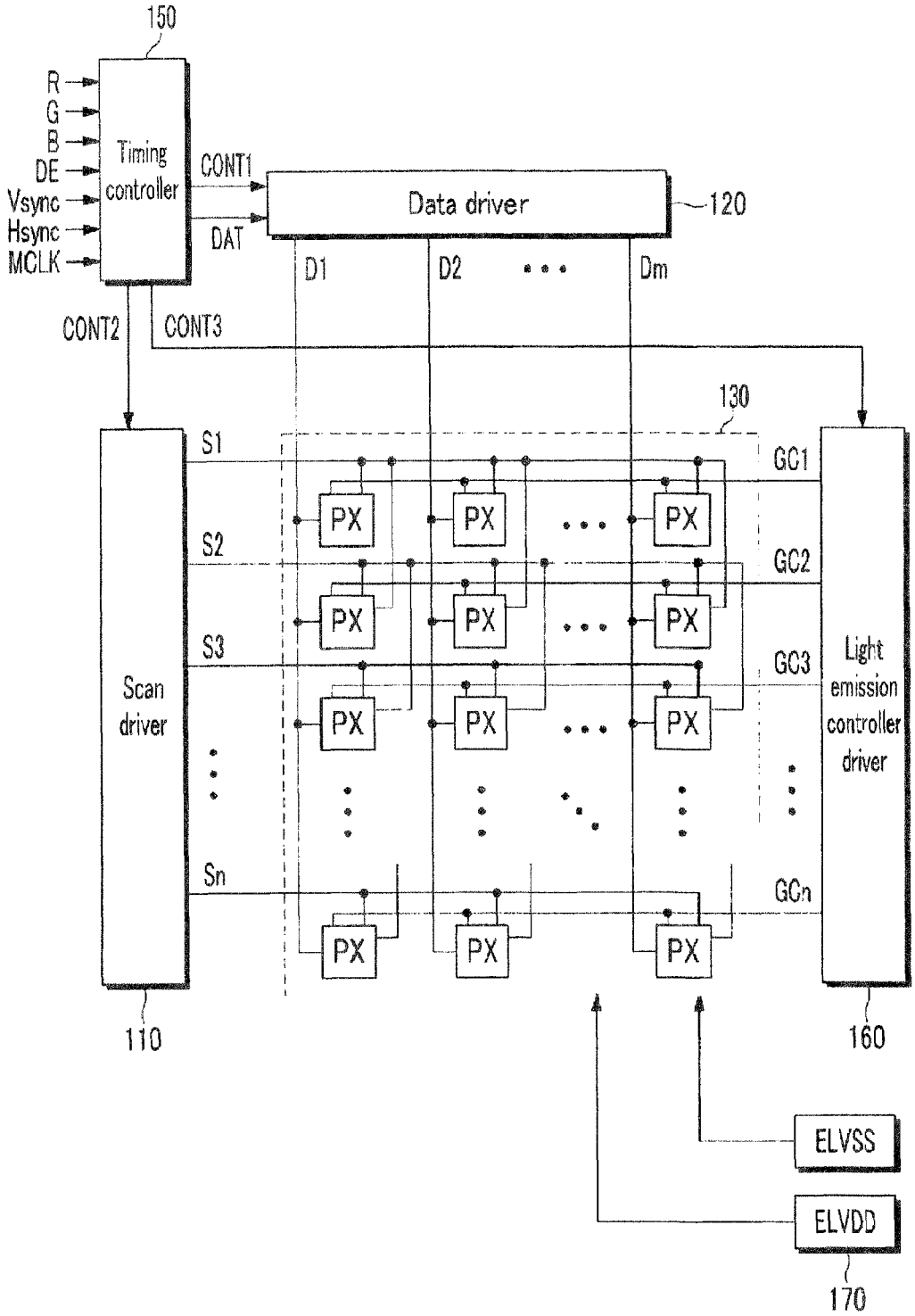
FIG. 5 is a block diagram of an organic light emitting diode (OLED) display according to an exemplary embodiment of the present invention.
Figure 6:
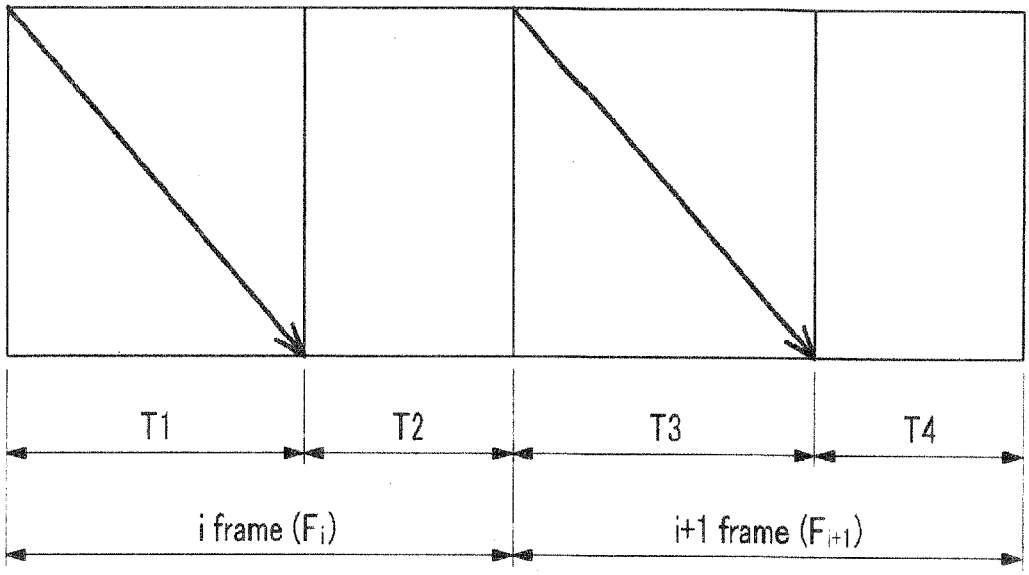
FIG. 6 is a view showing a driving operation of a light emitting method of the organic light emitting diode (OLED) display according to an exemplary embodiment of the present invention.

FIG. 5 is a block diagram of an organic light emitting diode (OLED) display according to an exemplary embodiment of the present invention, and FIG. 6 is a view showing a driving operation of a light emitting method of the organic light emitting diode (OLED) display according to an exemplary embodiment of the present invention.

Referring to FIG. 5, an organic light emitting diode (OLED) display includes a display unit 130 having a plurality of pixels PX connected to a plurality of scan lines S1 to Sn, a plurality of light emission control lines GC1 to GCn, and a plurality of data lines D1 to Dm.

Also, it includes a scan driver 110 providing scan signals to the plurality of pixels PX through the plurality of scan lines S1 to Sn, a light emission control driver 160 providing light emitting signals to the plurality of pixels PX through the plurality of light emission control lines GC1 to GCn, and a data driver 120 providing data signals to the plurality of pixels PX through the plurality of data lines D1 to Dm.

In detail, the data driver 120 is connected to the plurality of data lines D1 to Dm of the display unit 130, and converts the image data DAT input from a timing controller 150 into a plurality of data voltages according to a data control signal CONT1 to apply them to the plurality of data lines D1 to Dm.

The light emission control driver 160 transmits the light emitting signals Gc(1) to Gc(n) (see FIG. 8) to the plurality of light emission control lines GC1 to GCn according to the light emission control signal CONT3.

The scan driver 110 is connected to the scan lines S1 to Sn of the display unit 130, and progressively applies the plurality of scan signals Scan(1) to Scan(n) (see FIG. 8) to the plurality of scan lines S1 to Sn according to the scanning control signal CONT2.

The timing controller 150 controls the scan driver 110, the data driver 120, and the light emission control driver 160. The timing controller 150 receives image signals R, G, and B and input control signals to control display of the R, G, and B signals from an external device. The image signals R, G, and B include luminance information of each pixel PX, and the luminance has a predetermined number of gray values, for example $1024=2^{10}$, $256=2^{8}$, or $64=2^{6}$. Examples of the input control signals include a vertical synchronization signal Vsync, a horizontal synchronizing signal Hsync, a main clock signal MCLK, a data enable signal DE.

The timing controller 150 appropriately processes the input image signals R, G, and B according to the operation conditions of the display unit 130 and the data driver 120 on the basis of the input image signals R, G, and B and the input control signals, and generates a scanning control signal CONT1, a data control signal CONT2, an image data signal DAT, and a light emission control signal CONT3. The timing controller 150 transmits the scan control signal CONT2 to the scan driver 110. The timing controller 150 transmits the data control signal CONT1 and the image data signal DAT to the data driver 120. The timing controller 150 transmits the light emission control signal CONT3 to the light emission control driver 160.

In detail, the timing controller 150 generates the light emission control signal CONT3 to control the light emission control driver 160.

That is, the light emission control driver 160 generates the plurality of light emitting signals Gc(1) to Gc(n) according to the light emission control signal CONT3. The light emission control signal CONT3 corresponds to the controlling input SI1 or SI2 of FIG. 1 or FIG. 3, respectively.

Also, the display unit 130 includes a plurality of pixels PX positioned in the crossing regions of the scan lines S1 to Sn and the data lines D1 to Dm. The plurality of pixels PX receive a first power ELVDD from power driver 170 and a second power ELVSS from the outside.

The plurality of pixels PX respectively supply the current to the organic light emitting diode (OLED) (see FIG. 7) according to the corresponding data signals, and the organic light emitting diode (OLED) emits the light of a predetermined luminance according to the supplied current.

The organic light emitting diode (OLED) display according to an exemplary embodiment of the present invention is driven by a simultaneous emission with active voltage method.

As shown in FIG. 6, according to the simultaneous emission with active voltage method, the period of one frame includes scanning periods T1 and T3 in which the plurality of data signals are transmitted and programmed to all pixels, and light emitting periods T2 and T4 in which the plurality of pixels emit the light according to the corresponding data signals that are programmed after the data signals are transmitted to all pixels.

In FIG. 6, for better understanding and ease of description, only the i-th frame Fi and the (i+1)-th frame F(i+1) are shown among the plurality of continuous frames. The frame Fi includes the scanning period T1 and the light emitting period T2, and the frame F(i+1) includes the scanning period T3 and the light emitting period T4.

That is, in a case of a conventional progressive emission method, the data signals are progressively input for each scan line and then the light emitting is progressively executed, however in an alternative embodiment of the present invention, the input of the data signals is progressively executed, but the light emitting is executed in conjunction after the input of the data signal is finished.

Figure 7:
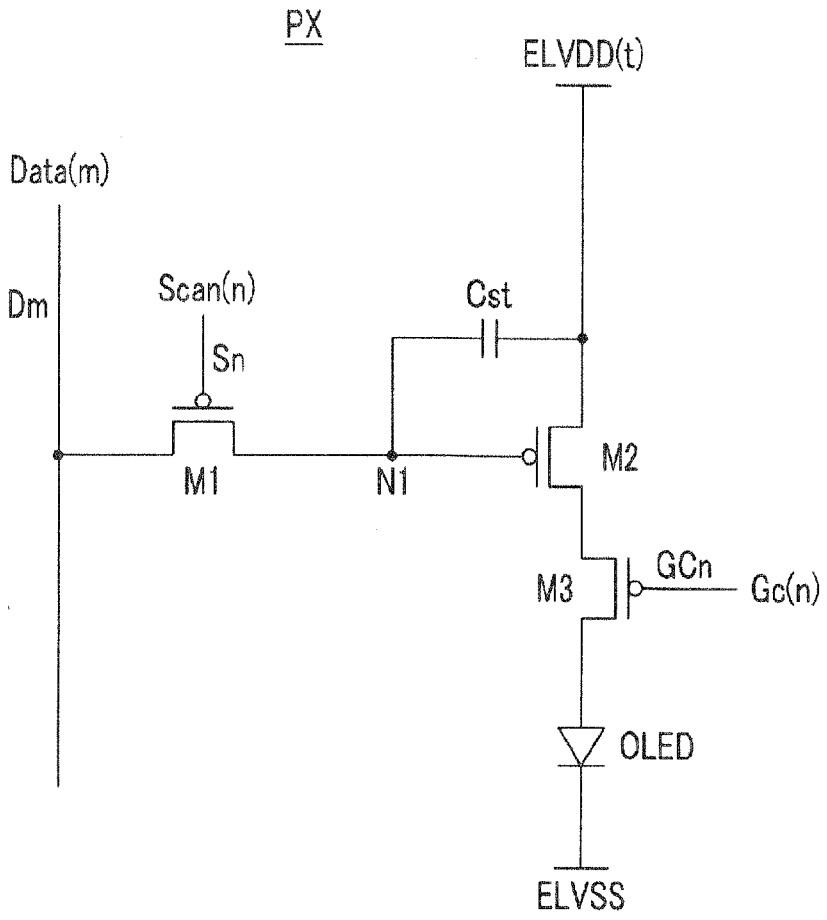
FIG. 7 is a circuit diagram showing configurations according to an exemplary embodiment of the pixel shown in FIG. 5.

FIG. 7 is a circuit diagram showing configurations according to an exemplary embodiment of the pixel shown in FIG. 5.

Referring to FIG. 7, the pixel PX includes an organic light emitting diode (OLED), a first switching transistor M1, a driving transistor M2, a second switching transistor M3, and a storage capacitor Cst.

The anode of the organic light emitting diode (OLED) is connected to the second switching transistor M3, and the cathode is connected to the second power ELVSS. The organic light emitting diode (OLED) emits a light of a predetermined luminance corresponding to a supplied current.

The gate electrode of the first switching transistor M1 is connected to the scan line Sn, and a first electrode is connected to the data line Dm. Also, a second electrode of the first switching transistor M1 is connected to a first node N1. The gate electrode of the first switching transistor M1 is input with the scan signal Scan(n), and the first electrode is input with the data signal Data(m).

The driving transistor M2 includes a gate electrode connected to the first node N1, a first electrode connected to the first power ELVDD, and a second electrode connected to a first electrode of the second switching transistor M3.

The capacitor Cst is connected to the gate electrode of the driving transistor M2, that is, between the first node N1 and the first power ELVDD, and the driving transistor M2 functions to apply the driving current according to the data signal Data(m) to the organic light emitting diode (OLED).

The second switching transistor M3 includes a gate electrode connected to the light emission control line GCn supplying the light emitting signal Gc(n), a first electrode connected to the second electrode of the driving transistor M2, and a second electrode connected to the anode of the organic light emitting diode (OLED).

The cathode of the organic light emitting diode (OLED) is connected to the second power ELVSS.

The first switching transistor M1, the driving transistor M2, and the second switching transistor M3 are all PMOS transistors. However, the first switching transistor M1, the driving transistor M2, and the second switching transistor M3 are not limited thereto, and can be NMOS transistors.

Figure 8:
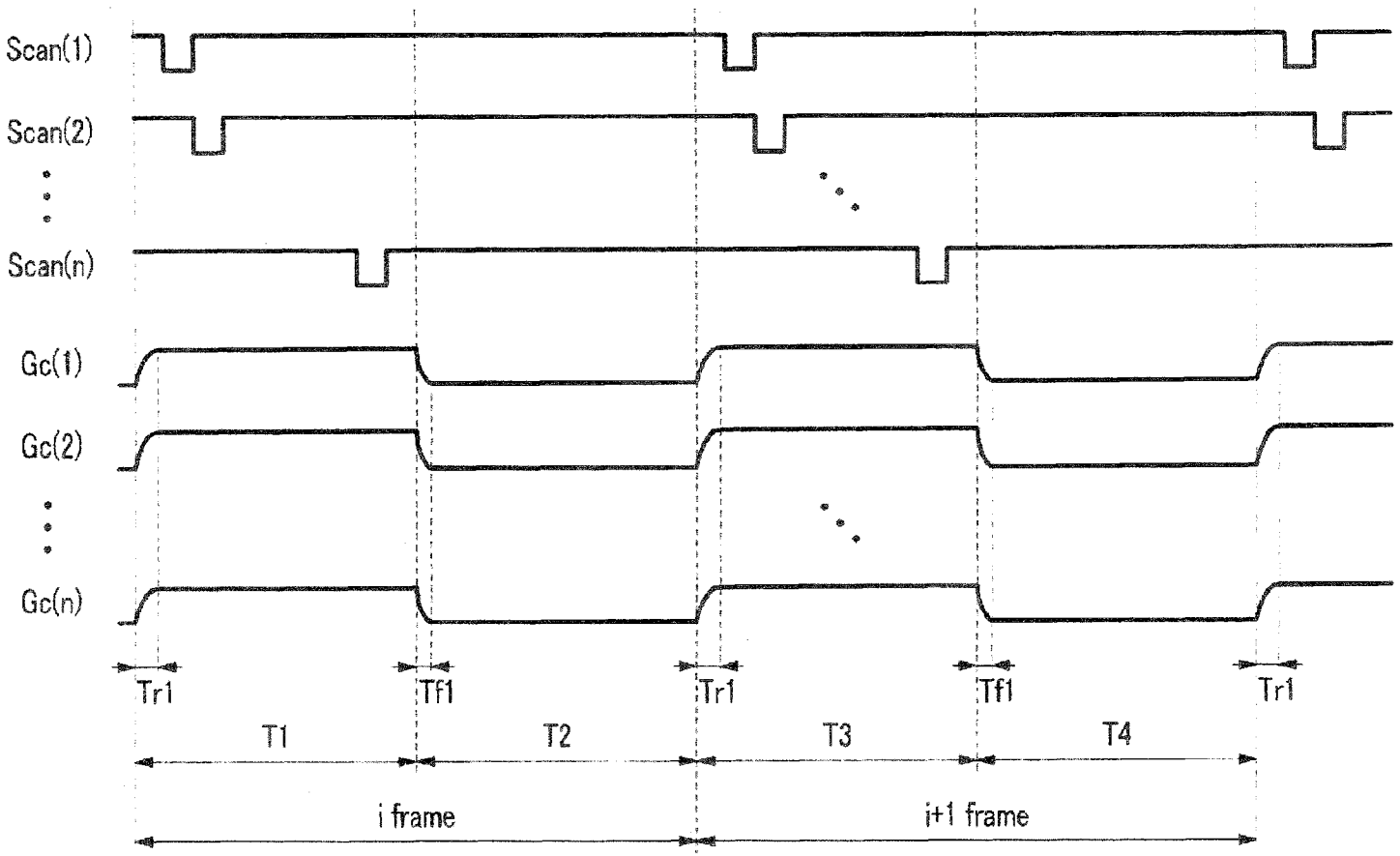
FIG. 8 is a waveform of a scan signal and a light emitting signal for a scanning period and a light emitting period.

FIG. 8 shows waveforms of scan signals Scan(1) to Scan(n) and light emitting signals Gc(1) to Gc(n) of the scanning periods T1 and T3 and the light emitting periods T2 and T4.

Referring to FIGS. 7 and 8, if the scan signal Scan(1) is decreased to the low level at the scanning period T1, the first switching transistor M1 is turned on during a predetermined period in which the scan signal Scan(1) is the low level such that the data voltage is transmitted to the first node N1. Accordingly the voltage difference between the transmitted data voltage and the first power ELVDD is charged to the capacitor Cst.

Next, if the scan signal Scan(2) is decreased to the low level, the first switch M1 is turned on during a predetermined period in which the scan signal Scan(2) is the low level such that the first node N1 is transmitted the data voltage. Accordingly, the capacitor Cst is charged with the voltage difference between the transmitted data voltage and the first power ELVDD.

If the scan signal Scan(n) is decreased to the low level, the first switch M1 is turned on during the predetermined period in which the scan signal Scan(n) is the low level such that the data voltage is transmitted to the first node N1. Accordingly, the capacitor Cst is charged with the voltage difference between the transmitted data voltage and the first power ELVDD.

During the scanning period T1, the light emitting signal Gc(1) is maintained at the high level such that the second switching transistor M3 is in the turned-off state. Accordingly, the current is not supplied to the organic light emitting diode (OLED).

If the light emitting signal Gc(1) is decreased to the low level in the light emitting period T2 after the scanning period T1, the second switching transistor M3 is turned on, and the current corresponding to the voltage difference between the gate electrode and the source electrode of the driving transistor M2 flows into organic light emitting diode (OLED) by the data voltage programmed during the scanning period T1.

Accordingly, the organic light emitting diode (OLED) simultaneously emits the light in all pixels at the light emitting period T2. Also, the scan signal Scan(n) is maintained at the high level in the light emitting period T2 such that the first switching transistor M1 maintains the turned-off state.

At the scanning period T3 after the light emitting period T2, if the scan signal Scan(1) is decreased to the low level, the first switching transistor M1 is turned on during the predetermined period in which the scan signal Scan(1) is the low level such that the data voltage is transmitted to the first node N1. Accordingly, the capacitor Cst is charged by the voltage difference between the transmitted data voltage and the first power ELVDD.

Next, if the scan signal Scan(2) is decreased to the low level, the first switching transistor M1 is turned on during the predetermined period in which the scan signal Scan(2) is the low level such that the data voltage is transmitted to the first node N1. Accordingly, the capacitor Cst is charged by the voltage difference between the transmitted data voltage and the first power ELVDD.

If the scan signal Scan(n) is decreased to the low level, the first switching transistor M1 is turned on during the predetermined period in which the scan signal Scan(n) is the low level such that the data voltage is transmitted to the first node N1. Accordingly, the capacitor Cst is charged with the voltage difference between the transmitted data voltage and the first power ELVDD.

During the scanning period T3, the light emitting signal Gc(1) is maintained at the high level such that the second switching transistor M3 is turned off. Accordingly, the current is not supplied to the organic light emitting diode (OLED).

If the light emitting signal Gc(1) is decreased to the low level at the light emitting period T4 after the scanning period T3, the second switching transistor M3 is turned on, and the current corresponding to the voltage difference between the gate electrode and the source electrode of the driving transistor M2 flows into the organic light emitting diode (OLED) by the data voltage programmed during the scanning period T3.

Accordingly, the organic light emitting diode (OLED) simultaneously emits the light in all pixels in the light emitting period T4. Also, the scan signal Scan(n) is maintained at the high level in the light emitting period T4 such that the first switching transistor M1 maintains the turned-off state.

Here, the i-th frame Fi and the (i+1)-th frame Fi+1 are described, however the present invention is not limited thereto, and this may be applied to all frames.

Of course, in the drawings, the n-th scan signal Scan(n), the scan line Sn, the n-th light emitting signal GC(n), the light emission control line GCn, the m-th data signal Data(m), and the data line Dm are shown, however the present invention is not limited thereto, this may be applied from the first signal and line to the n or m-th signal and line.

As described above, a plurality of pixels of the organic light emitting diode (OLED) display of the simultaneous emission with active voltage method simultaneously emit the light during the light emitting period, and the control signal having the waveform of which the falling period Tf1 is long is required in the case of the PMOS transistor incorporation circuit.

If the falling period Tf1 of the light emitting signal Gc(n) is short, the current flowing in each OLED of the plurality of pixels are generated within the short period. The current generated in the organic light emitting diode (OLED) display is rapidly increased within the short falling period Tf1 of the light emitting signal Gc(n). This influences the configuration of the organic light emitting diode (OLED) display, that is, the driver, the power unit, and the timing controller, and thereby the characteristic and the reliability of the configurations may be deteriorated.

In contrast, in the case in which the light emission control transistor is the NMOS transistor, when the rising period Tr1 of the light emitting signal is short, the same problems are generated.

Conventionally, the rising period Tr1 and the falling period Tf1 are equal to each other such that these problems may not be solved, however the present invention provides the signal generating circuit controlling the rising period and the falling period to be different, thereby solving these problems.

According to the conventional art equally controlling the rising period and the falling period, in the case that the long falling period is required, the rising period is increased such that unexpected other problems may be generated.

For example, if the rising period is increased according to the falling period of the light emitting signal in the previous exemplary embodiment, although the light emitting period is finished and the scan period is again started, the light emission control transistor is not sufficiently turned off, and thereby the problem that the current may flow into the OLED through the light emission control transistor at the scan period may be generated.

Accordingly, like an exemplary embodiment of the present invention, the signal generating circuit asymmetrically controlling the rising period and the falling period is required.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A signal generating circuit generating an output signal corresponding to a controlling input, comprising:

a rising path increasing the output signal during a rising period in synchronization with a time that the controlling input is increased;

a falling path decreasing the output signal during a falling period in synchronization with a time that the controlling input is decreased, the rising period being longer than the falling period; and a plurality of the signal generating circuits are utilized in a light emission control driver of a display device for providing light emitting signals to a plurality of pixels in the display device.

2. The signal generating circuit of claim 1, wherein the rising path includes, in series, a first resistor, a first diode, and a capacitor, the first diode is turned on in synchronization with the time that the controlling input is increased, and a power source voltage is charged to the capacitor through the first resistor according to the controlling input.

3. The signal generating circuit of claim 2, wherein the falling path includes, in series, a second resistor, a second diode, and said capacitor, the second diode is turned on in synchronization with the time that the controlling input is decreased, and the voltage charged to the capacitor is discharged through the second resistor according to the controlling input.

4. The signal generating circuit of claim 3, further comprising:

a controlling switch including one terminal connected to the first resistor and the second resistor and a gate electrode input with the controlling input; and a DC power unit, supplying the power source voltage, connected to the other terminal of the controlling switch.

5. The signal generating circuit of claim 4, wherein the first resistor includes one terminal connected to one terminal of the controlling switch and the other terminal connected to an anode of the first diode, the second resistor includes one terminal connected to said one terminal of the controlling switch and the other terminal connected to a cathode of the second diode, the first diode includes a cathode connected to one terminal of the capacitor, and the second diode includes an anode connected to said one terminal of the capacitor.

6. The signal generating circuit of claim 3, further comprising a controlling operational amplifier including an output terminal connected to one terminal of the capacitor, an inverting input terminal commonly connected directly to an anode of the second diode and a cathode of the first diode, and a non-inverting input terminal connected to ground.

7. The signal generating circuit of claim 6, wherein the controlling input is simultaneously transmitted directly to one terminal of the first resistor and one terminal of the second resistor.

8. The signal generating circuit of claim 7, wherein the first resistor includes said one terminal connected to said one terminal of the second resistor and another terminal connected to an anode of the first diode, the second resistor includes another terminal connected to a cathode of the second diode.

9. A display device comprising:

a display unit including a plurality of pixels, a plurality of scan lines, a plurality of data lines, and a plurality of light emission control lines;

a data driver transmitting a plurality of data signals to the plurality of data lines;

a scan driver transmitting a plurality of scan signals to the plurality of scan lines;

a light emission control driver transmitting a plurality of light emitting signals to the plurality of light emission control lines; and a timing controller generating a light emission control signal to control the light emission control driver;

the light emission control driver includes, at each of the light emission control lines, a rising path increasing the light emission control signal during a rising period in synchronization with a time that the light emission control signal is increased, and a falling path decreasing the light emission control signal during a falling period in synchronization with a time that the light emission control signal is decreased, the rising period and the falling period being different from each other.

10. The display device of claim 9, wherein the rising path includes, in series, a first resistor, a first diode, and a capacitor, the first diode is turned on in synchronization with the time that the light emission control signal is increased, and a power source voltage is charged to the capacitor through the first resistor according to the light emission control signal.

11. The display device of claim 10, wherein the falling path includes, in series, a second resistor, a second diode, and said capacitor, the second diode is turned on in synchronization with the light emission control signal is decreased, and the voltage charged to the capacitor is discharged through the second resistor according to the light emission control signal.

12. The display device of claim 11, further comprising:

a controlling switch including one terminal connected to the first resistor and the second resistor, and a gate electrode input with the light emission control signal; and a DC power unit, supplying the power source voltage, connected to the other terminal of the controlling switch.

13. The display device of claim 12, wherein the first resistor includes one terminal connected to one terminal of the controlling switch and the other terminal connected to an anode of the first diode, the second resistor includes one terminal connected to said one terminal of the controlling switch and the other terminal connected to a cathode of the second diode, the first diode includes a cathode connected to one terminal of the capacitor, and the second diode includes an anode connected to said one terminal of the capacitor.

14. The display device of claim 11, further comprising a controlling operational amplifier including an output terminal connected to one terminal of the capacitor, an inverting input terminal connected to an anode of the second diode and a cathode of the first diode, and a non-inverting input terminal connected to ground.

15. The display device of claim 12, wherein the light emission control signal is transmitted to one terminal of the first resistor and one terminal of the second resistor.

16. The display device of claim 15, wherein the first resistor includes one terminal connected to one terminal of the second resistor and another terminal connected to an anode of the first diode, the second resistor includes another terminal connected to a cathode of the second diode, the first diode includes a cathode connected to an inverting input terminal of a controlling operational amplifier, the second diode includes an anode connected to the inverting input terminal of the controlling operational amplifier, an output terminal of the controlling operational amplifier connected to one terminal of the capacitor, the inverting input terminal connected to another terminal of the capacitor, and a non-inverting input terminal connected to ground.

* * * * *